US010347406B2

(12) United States Patent
Li

(10) Patent No.: US 10,347,406 B2
(45) **Date of Patent: *Jul. 9, 2019**

(54) INTERNALLY SEGMENTED MAGNETS

(71) Applicant: Ford Global Technologies, LLC, Dearborn, MI (US)

(72) Inventor: Wanfeng Li, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 245 days.

This patent is subject to a terminal disclaimer.

(21) Appl. No.: 14/867,064

(22) Filed: Sep. 28, 2015

(65) Prior Publication Data

US 2017/0092398 A1 Mar. 30, 2017

(51) Int. Cl.

| | |
|---|---|
| ***H01F 1/00*** | (2006.01) |
| ***H01F 1/08*** | (2006.01) |
| ***H01F 41/02*** | (2006.01) |
| ***H01F 7/02*** | (2006.01) |
| *H01F 1/055* | (2006.01) |
| *H01F 1/057* | (2006.01) |

(52) U.S. Cl.

CPC ..... *H01F 7/021* (2013.01); *H01F 1/00* (2013.01); *H01F 1/086* (2013.01); *H01F 7/0231* (2013.01); *H01F 41/0253* (2013.01); *H01F 1/0557* (2013.01); *H01F 1/0577* (2013.01)

(58) Field of Classification Search

None

See application file for complete search history.

(56) References Cited

U.S. PATENT DOCUMENTS

| | | | | |
|---|---|---|---|---|
| 5,858,124 | A * | 1/1999 | Endo | H01F 1/0557 148/101 |
| 8,119,260 | B2 | 2/2012 | Komuro et al. | |
| 2008/0171216 | A1* | 7/2008 | Komuro | G01R 33/3806 428/546 |
| 2008/0241368 | A1 | 10/2008 | Komuro et al. | |
| 2008/0241513 | A1 | 10/2008 | Komuro et al. | |
| 2008/0317620 | A1 | 12/2008 | Suzuki et al. | |
| 2012/0153759 | A1 | 6/2012 | Kawashita et al. | |
| 2015/0099104 | A1 | 4/2015 | Liang et al. | |
| 2015/0155082 | A1* | 6/2015 | Marinescu | B82Y 25/00 428/332 |
| 2017/0092399 | A1* | 3/2017 | Li | H01F 7/021 |

* cited by examiner

*Primary Examiner* — Colleen P Dunn
*Assistant Examiner* — Rajinder Bajwa
(74) *Attorney, Agent, or Firm* — Dave Kelly; Brooks Kushman P.C.

(57) ABSTRACT

An internally segmented magnet is disclosed. The magnet may include a first layer of a permanent magnetic material, a second layer of a permanent magnetic material, and an insulating layer separating the first and second layers. The insulating layer may include a ceramic mixture of at least a first ceramic material and a second ceramic material. The mixture having a melting point of up to 1,100° C. and may be a eutectic, or near eutectic, composition. The magnet may be formed by forming a first layer of powdered permanent magnetic material, depositing an insulating layer over the first layer, depositing a second layer of powdered permanent magnetic material over the insulating layer to form an internally segmented magnet stack, and sintering the magnet stack. The ceramic materials may include a halogen and an alkaline earth metal, alkali metal, or a metal having a +3 or +4 oxidation state.

1 Claim, 3 Drawing Sheets

INTERNALLY SEGMENTED MAGNETS

TECHNICAL FIELD

This disclosure relates to segmented magnets, for example, internally segmented neodymium magnets.

BACKGROUND

Permanent magnet motors are common, and may be used in electric vehicles. Due to the high conductivity of sintered Nd—Fe—B magnets and the slot/tooth harmonics, eddy current losses may be generated inside the magnets. This may increase the magnet temperature and can deteriorate the performance of the permanent magnets, which may lead to a corresponding reduction in efficiency of the motors. In an attempt to address these issues and to make the magnets work at elevated temperatures, high coercivity magnets may be used in motors. These magnets typically contain expensive heavy rare earth (HRE) elements, such as Tb and Dy. Reducing eddy current losses can improve the motor efficiency and the materials cost can be decreased.

To decrease eddy current losses, the resistivity of the magnets has to be increased. There are typically two approaches to increasing resistivity. The first is to increase the overall resistivity of the magnet by mixing high resistivity materials into the magnets. However, this generally leads to deterioration in the magnetic properties. The second approach is to segment the magnet by separating the Nd—Fe—B magnets into thin slices with insulating materials therebetween. Such magnets are typically produced by gluing the sliced magnets using a polymer. This magnet segmentation process involves various manufacturing steps and increases the manufacturing cost of the magnet.

SUMMARY

In at least one embodiment, an internally segmented magnet is provided. The magnet may include a first layer of a permanent magnetic material; a second layer of a permanent magnetic material; and an insulating layer separating the first and second layers and including a ceramic mixture of at least a first ceramic material and a second ceramic material, the mixture having a melting point of up to 1,100° C.

In one embodiment, the first or second ceramic material may include a compound having a formula of $AH_2$, where A is an alkaline earth metal and H is a halogen. The halogen may include fluorine or chlorine and the alkaline earth metal may be selected from the group consisting of magnesium (Mg), calcium (Ca), and strontium (Sr). In another embodiment, the first or second ceramic material may include a compound having a formula of $MH_3$, where M is a metal having a +3 oxidation state and H is a halogen. In another embodiment, the first or second ceramic material may include a compound having a formula of BH, where B is an alkali metal and H is a halogen.

The ceramic mixture may have a melting point that is lower than a melting point of each of the first or second ceramic materials. The insulating layer may further include a metal or metal alloy. The metal or metal alloy may include iron, aluminum, copper, rare earth metals, or alloys thereof. In one embodiment, the metal comprises less than 20 wt. % of the insulating layer.

In at least one embodiment, a method of forming an internally segmented magnet is provided. The method may include forming a first layer of powdered permanent magnetic material; depositing an insulating layer over the first layer including a ceramic mixture of at least a first ceramic material and a second ceramic material; depositing a second layer of powdered permanent magnetic material over the insulating layer to form an internally segmented magnet stack; and sintering the magnet stack.

In one embodiment, the first and second ceramic materials may be chosen from a group consisting of: a compound having a formula of AH2, where A is an alkaline earth metal and H is a halogen; a compound having a formula of MH3, where M is a metal having a +3 oxidation state and H is a halogen; and a compound having a formula of BH, where B is an alkali metal and H is a halogen.

The ceramic mixture may have a melting point that is lower than a melting point of each of the first and second ceramic materials. The insulating layer may further include a metal or metal alloy. The metal or metal alloy may include iron, aluminum, copper, rare earth metals, or alloys thereof and the metal may comprise less than 20 wt. % of the mixture.

The insulating layer may further include a low melting point (LMP) material having a melting point of 30° C. to 400° C. The LMP material may have a boiling point that is less than a sintering temperature of the sintering step. The insulating layer may be pressed into a sheet prior to the first depositing step. The insulating layer may be pressed into the sheet at a temperature that is greater than the melting point of the LMP material and less than the boiling point of the LMP material. The method may also include a warm pressing step prior to the sintering step, wherein the warm pressing step includes heating the magnet stack to a temperature below the melting point of the LMP material.

In at least one embodiment, an internally segmented magnet green compact is provided. The green compact may include a first layer of a powdered permanent magnetic material; a second layer of a powdered permanent magnetic material; and an insulating sheet separating the first and second layers and including: a ceramic mixture of at least a first ceramic material and a second ceramic material; and a low melting point (LMP) material having a melting point of 30° C. to 400° C.

DETAILED DESCRIPTION

Figure 1:
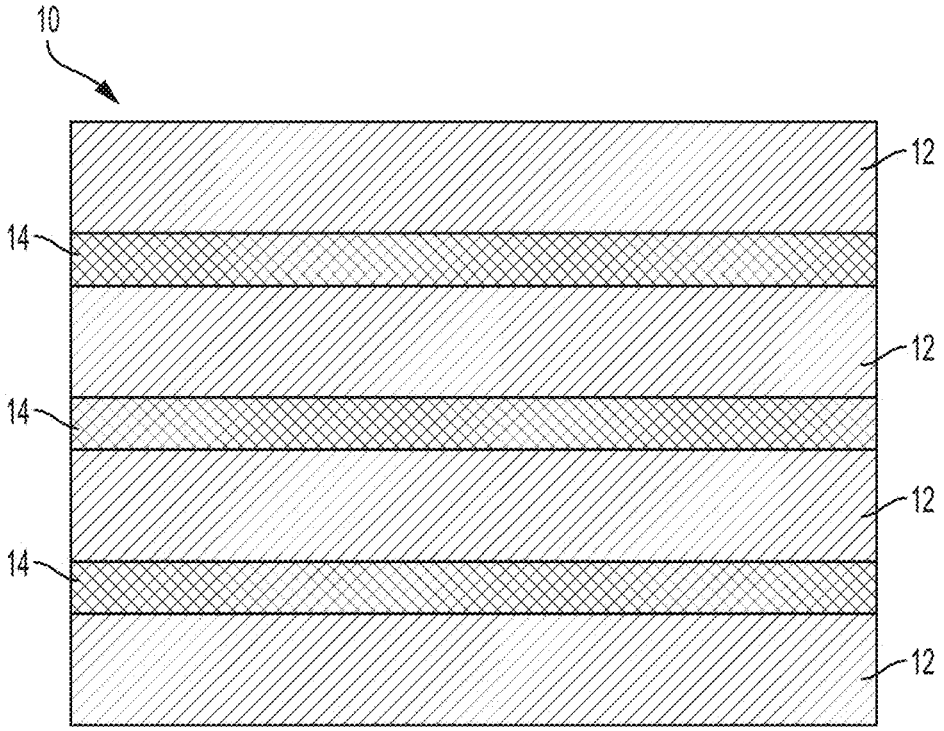
FIG. 1 is a schematic cross-section of an internally segmented magnet, according to an embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

To decrease the processing cost, an alternative way to segment magnets has been developed, which may be referred to as the internal segmentation technique. In this technique, the magnet may be segmented during sintering by placing insulating layers in the green compact. The insulating materials may be selected so that they do not deteriorate the magnetic properties, therefore, the insulating layer does not react with the hard magnetic phase. However, it has been found that the mechanical properties internally segmented magnets are very poor, in particular when the insulating layer is thick and uniform so that the hard magnetic phase is totally insulated. Accordingly, internally segmented magnets have been formed with very thin insulating layers, in which the insulating layer is too thin to be continuous, which have resulted in a very limited increase in resistivity due to insufficient insulation. For example, the insulating layers may only provide 2× to 3× increase in resistivity compared to the magnetic phase. In order to adequately insulate the magnetic material, the resistivity must be much higher, such as thousands, millions, or billions times higher than the magnetic material itself.

The disclosed internally segmented magnets, and methods of forming the same, may enhance/increase the mechanical properties of the internally segmented magnet. In order to improve the mechanical properties, both "adhesive" and "cohesive" forces need to be increased, considering the heterogeneous nature of such materials. The former, adhesive, may refer to the interaction near the interface between the magnet and the insulating layer(s) (IL). The latter, cohesive, may reflect the mechanical properties of the insulating materials forming the IL. In a sandwiched magnet-IL-magnet structure, the adhesive force may be the interaction between the insulating materials and the magnet materials (e.g., Nd—Fe—B), while the cohesive force may rely on the mechanical properties of the insulating layer itself. The insulating materials for the internally segmented magnet may be ceramic, which may not react with the main phase of the magnet and thus not deteriorate the magnetic properties. However, this lack of interaction may mean that there are no chemical bonds formed between the insulating layer and the Nd—Fe—B. The adhesive force may therefore be comprised of the relatively weak electrostatic interaction between these two materials, also called van der Waals force. It has been discovered that if the insulating materials are melted during sintering, the mechanical properties may be improved. It is believed that the improvement is due to the insulating materials spreading thinly and wetting the surfaces of the magnet phase very well, thereby improving the adhesive force.

With reference to FIG. 1, an internally segmented magnet 10 is shown in cross-section. The magnet 10 may have a plurality of magnetic layers 12 and one or more insulating layers (IL) 14. The insulating layers 14 may be disposed between magnetic layer 12 to increase the electrical resistance of the magnet 10 and decrease eddy current losses. The insulating layers 14 may be in direct contact with two spaced apart and opposing magnetic layers 12. The magnetic and/or insulating layers 14 may have a uniform or substantially uniform thickness (e.g., within 5% of the average thickness). There may be a plurality of insulating layers 14, for example, one insulating layer 14 between each pair of adjacent magnetic layers 12. In one embodiment, if there are "x" magnetic layers 12, then there may be "x−1" insulating layers 14. In the example shown in FIG. 1, there are four magnetic layers 12 and three insulating layers 14, however, there may be any suitable number of each layers. The magnet may include at least two magnetic layers 12, such that they are separated by an insulating layer 14. But, there may be 3, 4, 5, 10, or more magnetic layers 12, which may include corresponding, 2, 3, 4, 9 or more insulating layers 14 disposed between each pair of magnetic layers 12.

In at least one embodiment, the insulating layer(s) 14 may be relatively thin. For example, the insulating layer(s) 14 may have a thickness (e.g., average thickness) of 1 to 1,000 μm, or any sub-range therein. In one embodiment, the insulating layers 14 may have a thickness of 5 to 500 μm, 5 to 300 μm, 5 to 200 μm, 5 to 150 μm, 5 to 100 μm, 5 to 50 μm, 5 to 25 μm, 10 to 500 μm, 10 to 250 μm, 10 to 150 μm, 25 to 250 μm, 25 to 150 μm, 50 to 250 μm, 100 to 250 μm, or 150 to 250 μm. However, thicknesses outside of these ranges may also be possible. In one embodiment, the thickness may be thick enough to provide a continuous layer of resistive material despite the surface roughness of the magnetic layers 12.

The magnetic layers 12 may be formed of any suitable hard or permanent magnetic material. In one embodiment, the magnetic material may include a rare earth (RE) element, such as neodymium or samarium. For example, the magnetic material may be a neodymium-iron-boron (Nd—Fe—B) magnet or a samarium-cobalt (Sm—Co) magnet. The specific magnetic material compositions may include $Nd_2Fe_{14}B$ or $SmCo_5$, however, it is to be understood that variations of these compositions or other permanent magnet compositions may also be used. Other materials and/or elements may also be included in the magnetic material to improve the properties of the magnet (e.g., magnetic properties, such as coercivity), for example, heavy rare earth elements such as Y, Tb, Dy, Ho, Er, Tm, Yb, and Lu.

The insulating layers 14 may be formed of any suitable material having an electrical resistance greater than that of the magnetic layers 12. In one embodiment, the insulating layers 14 may include a ceramic material. One example of a material that has been tested is calcium fluoride ($CaF_2$). However, it has been found that insulating layers of $CaF_2$ must be made relatively thick to provide adequate resistivity. But, thick layers of $CaF_2$ are brittle, and result in a magnet having poor mechanical properties.

It has been discovered that mixtures of ceramic materials may be used in the insulating layers, which may have lower melting points than the constituent ceramics. These mixtures may utilize eutectic reactions. Although the ceramics tend to have high melting points, the eutectic reaction between ceramics can significantly decrease the melting point of a ceramic mixture. Even if the overall composition of the mixture of a system is not at or near the eutectic point, at the surface of the particles of the mixture the melting point can be significantly reduced. For the densification process of ceramics, formation of a liquid phase can enhance the densification rate, and therefore increase the cohesive force of the insulating layers. In liquid phase sintering, materials transport is much faster through a continuous liquid grain boundary film, assisted by capillary forces arising from voids in the liquid that resides in inter-particle interstices. Furthermore, increasing volume of liquid phase during sintering can also improve the interaction between the magnet and the insulating layers.

Figure 2:
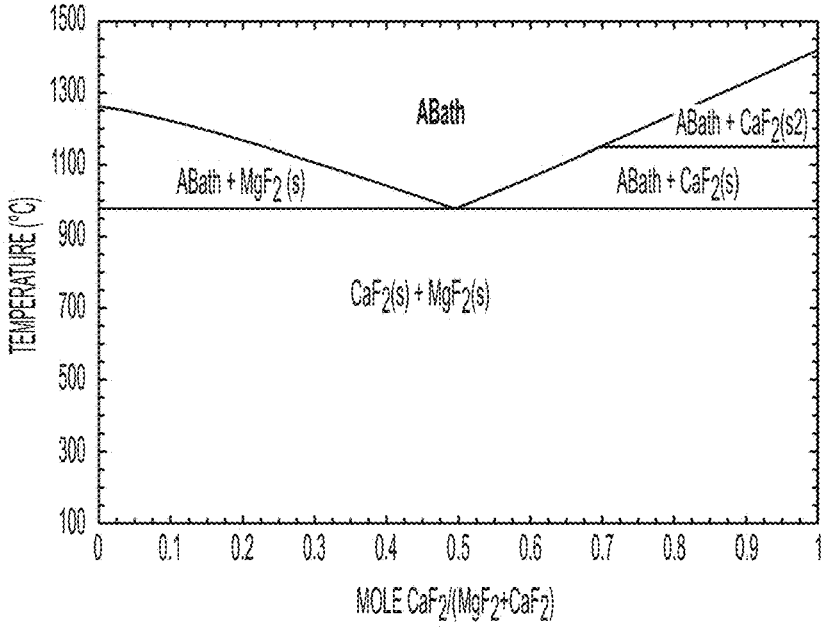
FIG. 2 is an example of a binary phase diagram including a eutectic reaction for a mixture of $CaF_2$ and $MgF_2$.

In one embodiment, the insulating layers may include a mixture (e.g., two or more) of compounds including an alkaline earth metal and a halogen. These compounds may have a formula of $AH_2$, where A is an alkaline earth metal and H is a halogen. The alkaline earth metals may include beryllium (Be), magnesium (Mg), calcium (Ca), strontium (Sr), barium (Ba), and radium (Ra). The halogens may include fluorine (F), chlorine (CO, bromine (Br), iodine (I), and astatine (At). In at least one embodiment, the alkaline earth metal may be calcium and/or magnesium. In at least one embodiment, the halogen may be fluorine (F) or chlorine (CO. Mixtures may be formed of two or more of any combination of the above. For example, the mixture may include $MgF_2$ and $CaF_2$. A phase diagram showing a mixture of $MgF_2$ and $CaF_2$ is shown in FIG. 2. The eutectic temperature for this system is about 980° C., which is much lower than either of the individual melting points of 1410° C. ($CaF_2$) and 1252° C. ($MgF_2$).

In addition to compounds of an alkaline earth metal and a halogen, the mixture may include one or more compounds including an alkali metal and a halogen. The alkali metals may include lithium (Li), sodium (Na), potassium (K), rubidium (Rb), or cesium (Cs). Accordingly, the mixture may include compounds such as LiF, NaF, KF, LiCl, NaCl, KCl, or any other combination. These compounds may have a formula of BH, where B is an alkali metal and H is a halogen. The mixture may also include one or more compounds of other metals, such as transition or basic metals, and halogens. For example, the metals may include aluminum (Al), zirconium (Zr), titanium, or others. The compounds may include $AlF_3$, $AlCl_3$, $ZrF_4$, $ZrCl_4$, or others.

The above compounds may be mixed in any combination to form binary, ternary, or quaternary systems, or more (e.g., systems having 2, 3, 4, or more components). The systems may include all one type of compound (e.g., a binary or ternary system with all alkaline earth metal-halogen or all alkali metal-halogen compounds), such as a $MgF_2$ and $CaF_2$ binary system or a LiF—NaF—KF ternary system. Or, the systems may be mixed, such as a binary system with an alkaline earth metal-halogen and an alkali metal-halogen compound or a ternary system with two of one and one of the other. Similarly, metal-halogen compounds may be incorporated into any of the above.

These binary, ternary, quaternary, or more, systems may be eutectic systems. The overall composition used for the insulating material mixture may be at or near to the eutectic point such that the melting point of the mixture is reduced compared to the constituent components. For example, the composition may be within a certain molar ratio of the eutectic point, such as 5%, 10%, 15%, 20%, 25%, or 30%. This is most simply described for a binary system, such as $MgF_2$ and $CaF_2$. The eutectic point of this system is at approximately 50% $CaF_2$ and 50% $MgF_2$, therefore for a composition that is within 20% of the eutectic point, the composition may be from 30% to 70% $CaF_2$ and 30% to 70% $MgF_2$. As described above, even if the composition of the mixture is not a eutectic composition, there may still be melting at the surface of the particles or powders at temperatures below the melting point. Accordingly, even relatively small amounts of a second or additional compound may improve the sintering. Therefore, the composition may include at least 5 molar % of a second or additional compound, for example at least 10 molar %, 15 molar %, 20 molar %, or 25 molar %. The second or additional compound may be either of the compounds in a binary system. For example, if the second compound is present at 20 molar % in the $MgF_2$ and $CaF_2$ system, the composition may be either 20 molar % $MgF_2$ or 20 molar % $CaF_2$. The same may apply to other binary systems or to ternary or quaternary systems.

Stated another way, the overall composition used for the insulating material mixture may be at or near to the eutectic point such that the melting point of the mixture at or near the eutectic point temperature. For example, the composition may be configured such that the melting point is within a certain temperature of the eutectic point temperature, such as within 5° C., 10° C., 25° C., 50° C., 75° C., or 100° C. Accordingly, if the composition is configured to have a melting point that is within 50° C. of the eutectic point temperature for a mixture of $MgF_2$ and $CaF_2$ (eutectic point of 980° C.), then the composition may have a melting point of 930° C. to 1030° C. However, since the eutectic point typically represents a minimum melting point (or at least a local minimum), the composition may have a melting point of the eutectic point temperature (980° C.) to 1030° C.

Depending on the composition of the mixtures used for the insulating layers, the melting point may vary. The composition of the insulating material mixture may be configured such that the melting point may be less than or equal to 1100° C., 1050° C., or 1000° C., for example, from 850° C. to 1100° C., 850° C. to 1000° C., 900° C. to 1050° C., 950° C. to 1100° C., or 950° C. to 1000° C. The melting point of the mixture may be less than a sintering temperature of the magnetic material. In one embodiment, the sintering temperature of the magnetic material may be from 1000° C. to 1100° C., for example 1025° C. to 1075° C. or about 1060° C. As described above, even if the composition of the mixture is not a eutectic composition (e.g., about 1:1 molar ratio for $MgF_2$ and $CaF_2$), there may still be melting at the surface of the particles or powders, thereby improving materials transport and densification during sintering.

By reducing the melting temperature of the insulating layer material, the cohesive force of the insulating layer may be improved. An increased cohesive force may allow the insulating layer to be thicker without compromising its mechanical properties. Accordingly, the internally segmented magnet may have thicker, and therefore for resistive, insulating layers while still providing a stable and mechanically sound structure. For example, the insulating layers may have a resistivity of at least $10^6$ Ωm, $10^7$ Ωm, or $10^8$ Ωm.

Figure 3:
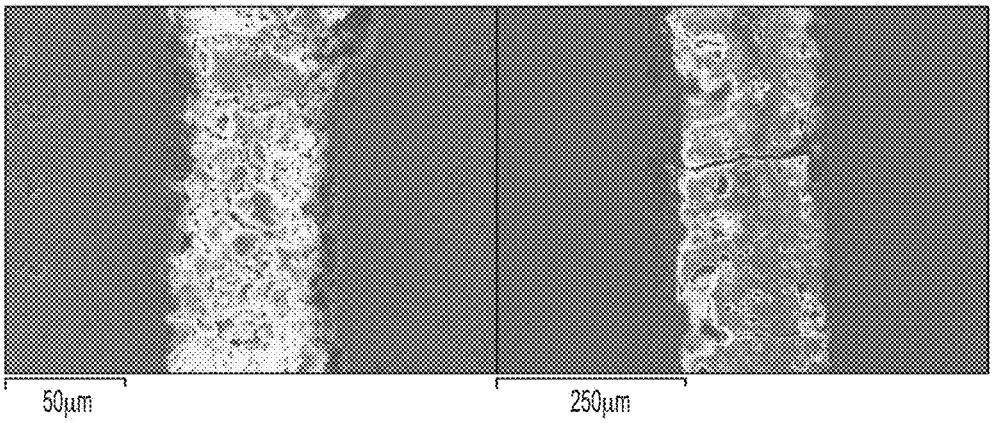
FIG. 3 is an SEM image comparing a $CaF_2$ insulating layer and an insulating layer include a mixture of $CaF_2$ and $MgF_2$.

An example of an internally segmented Nd—Fe—B magnet with a $CaF_2$+$MgF_2$ insulating layer is shown in FIG. 3. The mixture of $CaF_2$ and $MgF_2$ had a molar ratio of 3:7 and was sintered at 1060° C. for four hours. The effect of eutectic reaction (right) can be seen from the SEM image when compared with the magnet insulated only by $CaF_2$ (left). There is apparent grain growth in the insulating layer including a mixture of $CaF_2$ and $MgF_2$, which can improve the mechanical properties of the insulating layer and the magnet. In contrast, the $CaF_2$ particles, with a melting temperature well above the sintering temperature, did not melt, sinter, or undergo grain growth. Accordingly, the insulating layer on the left has very low cohesive force and is very brittle.

In another embodiment, the insulating layers may include a mixture of one or more compounds including an alkaline earth metal and a halogen and one or more metals. The former compounds may have a formula of $AH_2$, where A is an alkaline earth metal and H is a halogen. These may be similar to those described above. In general, metals may have a lower melting point than ceramics. In addition, some metals may improve the magnetic properties of the magnetic material. However, metals typically have very low electrical resistance, and including them in an insulating layer may be counter to the purpose of the insulating layer.

However, it has been discovered that the conductivity of a mixture of metallic and dielectric materials may be governed by the percolation theory. Therefore, the conductivity can be modulated by controlling the amount of metal or alloy powders in the mixture. When the volume ratio of the metallic component is less than a threshold value, the conductivity of the mixture may be close to zero. When the volume ratio of the metallic component is above the threshold value, approximately, conductivity of the mixture of a dielectric and a metallic component can be expressed as:

$$\sigma \sim (p-p_c)^{\mu}$$

Where μ is the critical exponent which describes the behavior of the conductivity with varying volume ratio of metal and insulating materials, p can be seen as the volume ratio of the metallic component, and $p_c$ is the threshold value indicating the formation of long range connectivity of metal phase. Therefore, metallic powders may be mixed with insulating powders to improve the mechanical properties of internally segmented magnet through enhanced interface reaction. If the volume ratio of the metallic powders is below the threshold, the insulating layer would be still dielectric.

The metal(s) that may be included in the mixture may have relatively low melting temperatures when compared with the ceramic insulating materials and the magnetic materials. For example, the metals may have a melting point that is less than the sintering temperature of the magnetic material (e.g., less than 1060° C.). Examples of metals that may be mixed with the insulating material mixture may include iron, aluminum, copper, gallium (Ga), titanium (Ti), indium (In), rare earth metals (e.g., cerium (Ce), dysprosium (Dy), erbium (Er), europium (Eu), gadolinium (Gd), holmium (Ho), lanthanum (La), lutetium (Lu), neodymium (Nd), praseodymium (Pr), promethium (Pm), samarium (Sm), scandium (Sc), terbium (Tb), thulium (Tm), ytterbium (Yb) and yttrium (Y)), or others. Alloys of the above materials (with each other or other elements), may also be used.

A table with resistivity values of several example insulating material mixtures is shown below. The mixtures include $CaF_2$ and varying amounts of iron. As shown, at a point between 15 wt. % and 20 wt. % iron, there is a switch from dielectric behavior to a measurable resistance. From 5 wt. % to 15 wt. %, the mixture acts as a dielectric, and from 20 wt. % to 40 wt. %, the mixture rapidly decreases in resistivity. However, including up to about 15 wt. % of metal in the insulating material may reduce the overall melting temperature of the insulating material (which improves cohesive force and interfacial bonding, as described above), while also improving the magnetic properties of the magnetic material. These improvements may be achieved without sacrificing the resistivity of the insulating layer. While the mixture has been described with a single $AH_2$ compound, a mixture of compounds may also be used, such as those described above. As previously described, a mixture of compounds may further reduce the melting temperature of the insulating layer(s).

| Materials | Resistivity (Ω · cm) |
|---|---|
| $CaF_2$ + 5 wt. % Fe | N/A |
| $CaF_2$ + 10 wt. % Fe | N/A |
| $CaF_2$ + 15 wt. % Fe | N/A |
| $CaF_2$ + 20 wt. % Fe | $1.501 \times 10^5$ |
| $CaF_2$ + 30 wt. % Fe | $1.46 \times 10^3$ |
| $CaF_2$ + 40 wt. % Fe | $2.6 \times 10^{-4}$ |

In the above embodiments, the insulating layers may be applied or deposited on a magnetic layer as a suspension or powder. For example, the insulating material may be in a suspension, which is then sprayed onto a magnetic layer. Alternatively, the insulating material may be a powder and the powder may be directly applied or deposited onto a magnetic layer. Accordingly, the formation of the magnet structure prior to sintering may include laying down or depositing a layer of magnetic powder (e.g., Nd—Fe—B powder), for example, in a mold or die, and then applying a layer of insulating material on the magnetic powder. This process may be repeated to form alternating layers of un-sintered magnetic material and insulating material. The layers may be packed down or pressed before a subsequent layer is applied. Alternatively, the layers may be pressed only after each magnetic layer is applied. In one embodiment, at least the magnetic material may be deposited into the mold or die in a non-reactive atmosphere, such as argon or nitrogen, or protected from oxidation using any other method. Once all layers are deposited, the magnet may be pressed into a green compact and sintered.

While the above loose or non-rigid application of the insulating layer material (e.g., spray or powder) may be effective, the use of a sheet or other pre-formed layer for the insulating layer may make controlling the thickness and uniformity of the layer easier. When applying a loose insulating material to a pressed, but un-sintered magnetic layer, it may be difficult to ensure a uniform thickness of the insulating layer or to ensure there are no gaps or cracks in the insulating layer. It has been discovered that a pre-formed insulating layer, for example a sheet, may provide improved control of the insulating layer thickness and uniformity, as well as easier handling. However, insulating layers may be formed of ceramics which are very brittle, and hard to prepare in very thin layers. In addition, these layers can be easily broken during pressing, which may significantly decrease the resistivity.

Figure 4:
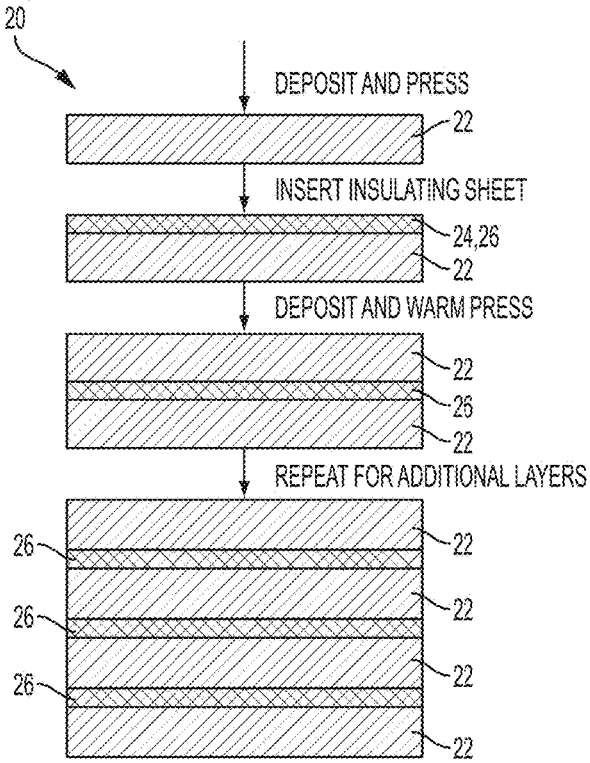
FIG. 4 is a schematic of a method of forming an internally segmented magnet, according to an embodiment.

With reference to FIG. 4, a schematic of the assembly of an internally segmented magnet 20 is shown. The magnet 20 may be formed with magnetic layers 22, which may be similar to those described above (e.g., powders of Nd—Fe—B) and insulating layers 24, which may be pre-formed insulating sheets 26. As shown, a first magnetic layer 22 may be deposited, for example in a mold or die. The magnetic layer 22 may then be pressed and an insulating sheet 26 may be applied or inserted on or over the magnetic layer 22 (e.g., in direct contact). Since the sheet 26 is pre-formed, it may have a predetermined thickness, which may be uniform or substantially uniform. After the insulating sheet 26 is inserted, another magnetic layer 22 may be deposited on or over the insulating sheet 26 (e.g., in direct contact). This layer of magnetic material may be pressed similar to the first deposited layer, however, heat may be applied during any or all presses done once the insulating sheet(s) 26 have been inserted. As explained in further detail below, the added heat may prevent or reduce breaking or cracking of the insulating sheet(s) 26 prior to sintering. Additional layers of magnetic material and insulating sheets may be added to the die or mold in alternating order to form a final internally segmented, un-sintered green compact.

As described above, insulating sheets formed of ceramics are generally brittle and difficult to form in thin layers. It has been discovered that more malleable or ductile insulating sheets may be formed by mixing the insulating material with a soft, low melting point (LMP) material. The LMP material may act as a binder or glue to improve the ductility of the sheets, prevent them from breaking/cracking, and improve their handling ability. In one embodiment, the LMP material may have a melting point that is slightly above room temperature (e.g., above about 25° C.). Accordingly, the LMP material may be solid when preparing and handling the sheet, but may begin to melt without the addition of large amounts of heat. However, processing may be performed below room temperature, therefore, the melting point may be less than room temperature. In one embodiment, the LMP material may have a melting point of 0° C. to 500° C., or any sub-range therein. For example, the melting point of the LMP material may be from 10° C. to 450° C., 20° C. to 400° C., 25° C. to 400° C., 30° C. to 400° C., 30° C. to 350° C., 30° C. to 300° C., 30° C. to 250° C., 30° C. to 200° C., 30° C. to 150° C., 30° C. to 100° C., 35° C. to 90° C., 40° C. to 90° C., 45° C. to 85° C., 45° C. to 80° C., 50° C. to 80° C., 55° C. to 80° C., 55° C. to 75° C., 60° C. to 75° C., 60° C. to 70° C., or about 64° C. (e.g., ±3° C.).

In one embodiment, the LMP material may have a relatively low boiling point, which may be less than a sintering temperature of the magnetic material (e.g., 1060° C.). For example, the boiling point of the LMP material may no higher than 500° C., such as less than or equal to 450° C., 400° C., 350° C., 300° C., 250° C., 200° C., 150° C., 125° C. or 100° C. The boiling point of the LMP material may be from 100° C. to 500° C., or any sub-range therein, such as 100° C. to 450° C., 150° C. to 400° C., 150° C. to 350° C., 150° C. to 300° C., 175° C. to 300° C., 175° C. to 250° C., 175° C. to 225° C., or about 200° C. (e.g., ±5° C.).

The ratio of LMP material to the insulating material mixture may be any suitable amount to bind and hold the insulating material into a sheet. In one embodiment, the LMP material may comprise 1 to 50 wt. % of the insulating sheet, or any sub-range therein. For example, the LMP material may comprise 1 to 40 wt. %, 5 to 50 wt. %, 5 to 40 wt. %, 10 to 40 wt. %, 10 to 35 wt. %, 15 to 35 wt. %, 20 to 30 wt. %, or about 25 wt. % (e.g., ±5 wt. %).

When mixed with the insulating material (e.g., powders), the glue-like LMP materials may combine or bind the powders together. The LMP material and the insulating material may be heated and pressed to form a sheet. The mixture may be heated to a temperature that is above the melting point of the LMP material but below the boiling point of the LMP material. The mixture may be heated to a temperature that is above, but within a certain temperature of the melting point, such as within 5° C., 10° C., 20° C., or 50° C. For example, if the melting point of the LMP material is 60° C., and the mixture is to be heated to within 20° C. of the melting point, it may be heated to between 60° C. and 80° C. The LMP material may alternatively be heated to the above temperatures and then mixed with the insulating material (e.g., the materials may be mixed then heated or heated then mixed). The sheets may be sized for a certain magnet or may be larger and afterward cut to size. Pressing into a sheet may increase the density of the insulating materials, and therefore the resistivity of the magnet.

After the sheets have been pressed and sized (if necessary), they may be inserted into a mold or die on top of a pressed magnetic layer (e.g., Nd—Fe—B powder). Another layer of magnetic material may be deposited on top of the insulating sheet and then the layers may be pressed. As described with reference to FIG. 4, the pressing may be a "warm" press. Any presses performed on the un-sintered magnet stack that include one or more insulating sheets may be a warm press. The temperature of the warm press may be near, but below, the melting point of the LMP material. This may soften the insulating sheet and cause the sheets to have increased ductility during the warm pressing operation.

In one embodiment, the warm press may be at a temperature that is from 50% to 99% of the melting point of the LMP material, or any sub-range therein. For example, the warm press may be at a temperature that is from 60% to 99%, 70% to 99%, 75% to 99%, 80% to 99%, 85% to 99%, or 90% to 99% of the melting point of the LMP material. Stated another way, the warm press may be performed at a temperature that is within, but below, a certain number of degrees of the LMP material melting point. In one embodiment, the warm press may be performed at a temperature that is within, but below, 100, 75, 50, 40, 30, 20, or 10 degrees of the LMP material melting point. In another embodiment, the warm press may be at a temperature that is above the melting point of the LMP material.

Once the alternating layers of magnetic powder and insulating sheets have been pressed into a final green compact, the magnet may be sintered. Accordingly, the bonding between the magnetic and insulating layers may occur without any adhesive or resin, such as polymers or epoxies. The insulating layer may, in one embodiment, consist of only inorganic materials (e.g., ceramics) and metal(s). As described above, the sintering temperature may depend on the composition of the magnetic material. In one embodiment, the sintering temperature of the magnetic material may be from 1000° C. to 1100° C., for example 1025° C. to 1075° C. or about 1060° C. However, other sintering temperatures may be used depending on the material. Since the LMP material may have a boiling point that is below the sintering temperature, the LMP material may vaporize during the sintering process. This may leave the insulating material behind to form high resistance layer(s) between the magnetic layers, thereby reducing eddy current losses.

In one embodiment, the sintering temperature may be slowly ramped up or there may be a two-step sintering process with a lower temperature and a higher temperature. This may prevent the LMP material from quickly vaporizing, which may make the remaining insulating material layer unstable. If, instead, the LMP material is heated slowly or initially to a lower temperature, the insulating material may be allowed to rearrange within the insulating layer and therefore be more stable when the LMP material vaporizes. The lower temperature may be near or above the boiling point of the LMP material but below the melting point of any phases of the magnet.

In the pre-formed sheet embodiments, the insulating material(s) may be any of the materials or material mixtures disclosed above. For example, the insulating material may include a mixture of $MgF_2$ and $CaF_2$ powders or a mixture of an $AH_2$ compound and one or more metals (e.g., Fe, Al, Cu, RE). The glue-like or LMP material may be any suitable material having the disclosed relatively low melting point and relatively low boiling point. The LMP material may be a wax, which may be natural or synthetic. Examples of types waxes that may be used could include animal waxes (e.g., beeswax), vegetable waxes (e.g., carnauba wax), mineral waxes (e.g., peat wax), petroleum waxes (e.g., paraffin wax), or synthetic waxes (e.g., polyethylene wax). The LMP material may include or be formed of other materials, such as thermoplastics (e.g., polyolefins, such as PE or PP).

Figure 5:
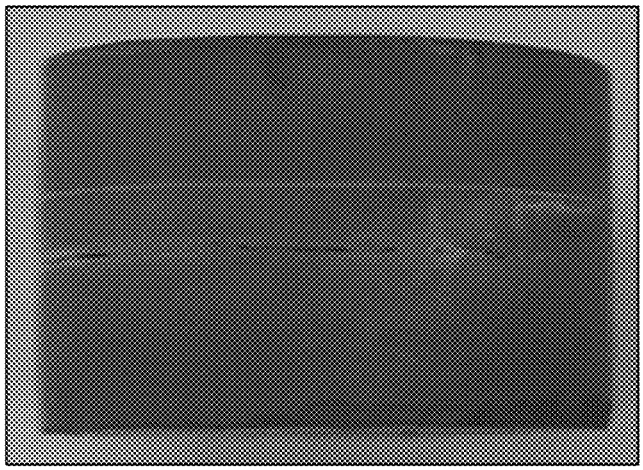
FIG. 5 is an image of an internally segmented magnet formed according to an embodiment.

In one example, shown in FIG. 5, a magnet was formed having two Nd—Fe—B magnet layers separated by an insulating layer sheet. The insulating layer included beeswax as the LMP material, which has a melting point of 64° C. and a flashing point of 200° C., meaning it vaporize at 200° C. The preformed sheet was prepared by mixing the beeswax with a mixture of $CaF_2$ and $MgF_2$ powders at a ratio of 2:8 (e.g., about 20 molar % $CaF_2$). The ratio of LMP material to insulating material (mixture of $MgF_2$ and CaF2) was 1:3. The insulating sheet mixture was then heated up to 80° C. and pressed. The thickness of the layer was about 150 μm. The insulating sheet was placed on the top of a first pressed segment of Nd—Fe—B magnet powder and then Nd—Fe—B powder was placed on the top of the insulating sheet and pressed. The second/final pressing was performed at a temperature of 30° C. The green compact was then sintered at 220° C. for 30 minutes and then 1060° C. for four hours. The sintered magnet prepared according to the above steps is shown in FIG. 5.

The disclosed magnets may be used in any magnetic application where hard/permanent magnets are used. The magnets may be beneficial where eddy currents are generated. In one embodiment the magnets may be used in electric motors or generators, such as those used in hybrid or electric vehicles. The disclosed magnets and methods of forming the same may decrease the temperature of the magnet, such that lower coercivity is required for the magnet. Therefore, less HRE materials are needed, which reduces costs of electric motors. It also saves energy, which may increase the MPG (miles/gallons) or electric range of electrical vehicles. The internally segmented magnet and process may also reduce machining costs associated with externally segmented magnets.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An internally segmented magnet, comprising:

first and second layers of a permanent magnetic material; and an insulating layer separating the first and second layers and consisting of a binary ceramic mixture including 30% to 70% $CaF_2$ and 30% to 70% $MgF_2$, and about 5 wt. % iron to about 15 wt. % iron.

* * * * *